US007053880B2

(12) United States Patent
Lim et al.

(10) Patent No.: US 7,053,880 B2
(45) Date of Patent: May 30, 2006

(54) METHOD OF COLOR IMAGE DISPLAY FOR A FIELD SEQUENTIAL LIQUID CRYSTAL DISPLAY DEVICE

(75) Inventors: Moo-Jong Lim, Seoul (KR); Hyung-Ki Hong, Seoul (KR)

(73) Assignee: LG.Philips Co., Ltd., Seoul (KR)

( * ) Notice: Subject to any disclaimer, the term of this patent is extended or adjusted under 35 U.S.C. 154(b) by 139 days.

(21) Appl. No.: 09/986,631

(22) Filed: Nov. 9, 2001

(65) Prior Publication Data

US 2002/0057253 A1 May 16, 2002

(30) Foreign Application Priority Data

Nov. 9, 2000 (KR) ..... 2000-0066450

(51) Int. Cl.
*G09G 3/36* (2006.01)

(52) U.S. Cl. ..... 345/102; 345/88; 345/103; 345/690

(58) Field of Classification Search ..... 345/87–89, 345/102–103, 204–205, 211, 690–693; 362/561
See application file for complete search history.

(56) References Cited

U.S. PATENT DOCUMENTS 5,359,345 A * 10/1994 Hunter ..... 345/102
5,796,378 A * 8/1998 Yoshida et al. ..... 345/88
5,808,597 A * 9/1998 Onitsuka et al. ..... 345/102

(Continued)

OTHER PUBLICATIONS

A. Kunzman et al.; "White Enhancement for Color-Sequential DLP"; Texas Instruments; SID 98 DIGEST; 1998; (pp. 121-124).

(Continued)

*Primary Examiner*—Henry N. Tran
(74) *Attorney, Agent, or Firm*—McKenna Long & Aldridge LLP

(57) ABSTRACT

A field sequential liquid crystal display device comprises a liquid crystal panel having an upper substrate, a lower substrate and a liquid crystal layer disposed therebetween, a back light disposed under the liquid crystal panel for irradiating a light to the liquid crystal panel and having 3 different light sources Red, Green and Blue sequentially driven; and an image signal processor controlling a lighting speed of each of the light sources Red, Green and Blue.

A method of color image display for a field sequential liquid crystal display device including an image signal processor, comprises steps of dividing a frame into four sub-frames having a period of one-fourth of one frame period, driving each of light sources Red, Green and Blue sequentially at a first, a second and a third sub-frame, driving a light source combination with three or fewer colors of Red, Green and Blue at a fourth sub-frame, classifying each component R, G and B of a color image input signal using a gray level having 256 levels, deciding a maximum luminance value of the field sequential liquid crystal display device using the gray level, obtaining an average luminance value of each of component R, G and B from the image input signal, turning on one of light sources Red, Green and Blue having an average luminance value greater than the maximum luminance value at the fourth sub-frame, and converting the input luminance value of component R, G and B and an input luminance value of the fourth sub-frame using the image signal processor.

Additionally, the method provides a time interval between driving sections of a previous light source and a next light source.

21 Claims, 8 Drawing Sheets

U.S. PATENT DOCUMENTS

| | | | | |
|---|---|---|---|---|
| 6,115,016 | A * | 9/2000 | Yoshihara et al. | 345/88 |
| 6,392,620 | B1 * | 5/2002 | Mizutani et al. | 345/88 |
| 6,570,554 | B1 * | 5/2003 | Makino et al. | 345/102 |
| 6,573,882 | B1 * | 6/2003 | Takabayashi | 345/102 |
| 6,608,614 | B1 * | 8/2003 | Johnson | 345/102 |
| 6,828,954 | B1 * | 12/2004 | Yoshihara et al. | 345/102 |
| 2003/0058210 | A1 * | 3/2003 | Yamazaki et al. | 345/89 |

OTHER PUBLICATIONS

N. Ogawa, et al.; "Field-Sequential-Color LCD Using Switched Organic EL Backlighting"; Toyota Motor Corporation; SID 99 DIGEST; 1999; (pp. 1098, 1100-1101).

Lars Yoder; "The Digital Display Technology of the Future"; Texas Instruments Incorporated; pp. 1-7.

* cited by examiner

METHOD OF COLOR IMAGE DISPLAY FOR A FIELD SEQUENTIAL LIQUID CRYSTAL DISPLAY DEVICE

This application claims the benefit of Korean Patent Application No. 2000-66450, filed on Nov. 9, 2000 in Korea, which is hereby incorporated by reference.

BACKGROUND OF THE INVENTION

1. Field of the Invention

The present invention relates to an active-matrix liquid crystal display (AM LCD) device, and more particularly, to a field sequential liquid crystal display device and a method of color image display for the field sequential liquid crystal display device. Although the present invention is suitable for a wide scope of applications, it is particularly suitable for improving a field sequential liquid crystal display device leading to an increase of instantaneous luminance of specific color and a decrease of response time of a liquid crystal, for example.

2. Discussion of the Related Art

Until now, the cathode-ray tube (CRT) has been generally used for display systems. However, flat panel displays are increasingly beginning to be used because of their small depth dimensions, desirably low weight, and low power consumption. Presently, thin film transistor-liquid crystal displays (TFT-LCDs) have been developed with a high resolution and small depth dimensions.

Generally, a liquid crystal display (LCD) device includes an upper substrate, a lower substrate, and a liquid crystal layer interposed between the upper and lower substrates. The upper and lower substrates respectively have electrodes opposing to each other. When an electric field is applied between the electrodes of the upper substrate and the electrodes of the lower substrate, molecules of the liquid crystal are aligned according to the electric field. By controlling the electric field, the liquid crystal display device provides varying transmittance of the light of incident to the display images.

Currently, an active-matrix liquid crystal display (AM LCD) device is the most popular because of its high resolution and superiority in displaying moving images. A typical active-matrix liquid crystal display has a plurality of switching elements and pixel electrodes, which are arranged in an array matrix on the lower substrate. Therefore, the lower substrate of the active-matrix liquid crystal display is alternatively referred to as an array substrate.

The structure of a conventional active-matrix liquid crystal display will be described hereinafter with reference to FIG. 1, which illustrates a cross-section of a pixel region. The active-matrix liquid crystal display 10 consists of a liquid crystal panel 15 and back light 50. The liquid crystal panel 15 includes a color filter substrate (an upper substrate) 20 and an array substrate (a lower substrate) 40 which face each other across a liquid crystal layer 30. A color filter layer 22, which includes a black matrix 22*b* for excluding a leakage of light and sub-color-filters 22*a*, consisting of red (R), green (G), and blue (B), is formed on the color filter substrate 20. A common electrode 24 is formed on the color filter layer 22 as one of electrodes for applying a voltage to the liquid crystal layer 30. A thin film transistor, for functioning as a switching element, and a pixel region are formed on the array substrate 40 facing the color filter substrate 20. A pixel electrode 42, electrically connected to the thin film transistor and functioning as another electrode in applying a voltage to the liquid crystal layer 30, is formed on the array substrate 40. The back light 50 is disposed under the array substrate 40 to irradiate light to the liquid crystal panel 15. This liquid crystal display device uses optical anisotropy and polarization properties of liquid crystal molecules for displaying a desired image. That is, applying a voltage to the liquid crystal molecules having a thin and long structure and a pretilt angle changes an alignment direction of the liquid crystal molecules. Thereafter, incident light from the back light is polarized due to the optical anisotropy of the liquid crystal molecules. And lastly, the polarized light is modulated by passing through the color filter layer and thus color images are displayed. The thin film transistor includes a gate electrode and a source and a drain electrodes (not shown).

But the conventional active-matrix liquid crystal display device has some problems. First, the material used for the color filter is expensive and the methods for manufacturing the color filter require more material to be consumed in the manufacturing process, resulting in an increase in the manufacturing cost. Second, the maximum value of a transmissivity of a material used for the color filter is 33%, so that a brighter back light needs to be used in order to display a color image effectively, which results in the increase of the power consumption. Last, when the color filter is thick, properties of color are fine, but the transmissivity is decreased. On the other hand, when the color filter is thin the transmissivity can be raised but, the color properties will become poor. Therefore, a manufacturing process having great precision is required for the color filter, which results in a decrease in production yield and an increase in the rate of inferior goods.

Many studies and experiments have been conducted recently, and a field sequential liquid crystal display device, able to display a full color without the color filter, is suggested as an alternative. The field sequential liquid crystal display devices display a color image by turning on light sources Red, Green and Blue sequentially during a frame, whereas the conventional active-matrix liquid crystal display devices display the color image by a white light source of the back light that is constantly turned on. The field sequential liquid crystal display device has not been popular until recently because of poor response time. However, development of new liquid crystal modes such as Ferroelectric Liquid Crystal (FLC), Optical Compensated Birefringent (OCB) and Twisted Nematic (TN) having a high response time of the liquid crystal can result in more wide spread use of the field sequential liquid crystal. In addition, the Optical Compensated Birefringent (OCB) mode is generally used for the field sequential liquid crystal display device. Both surfaces of an upper and a lower substrates are rubbed in a same direction and thereafter a voltage is applied to form a band-structure of the liquid crystal in OCB mode. Because the movement of liquid crystal molecules becomes faster when the voltage is applied to the liquid crystal, the response time of the liquid crystal becomes fast-within about 5 m/sec. Accordingly, the liquid crystal cell of the OCB mode is suitable for the field sequential liquid crystal display device because of its high response time leaving no residual image on a screen.

FIG. 2 is a cross-sectional view illustrating the schematic cross section of the conventional field sequential liquid crystal display device. The conventional field sequential liquid crystal display device 60 includes an upper substrate 64 (referred to as a color filter substrate), a lower substrate 66 (referred to as an array substrate), a liquid crystal layer 70 interposed the upper and lower substrates and a back light 72 consisting of three light sources Red, Green and Blue to irradiate light to the liquid crystal panel 62. A black matrix 61 is formed between the common electrode 65 and a transparent substrate 1 of the upper substrate 64 in order to intercept light in a region other than a region of the common electrode 65. A thin film transistor functioning as a switching element and electrically connected to the pixel electrode is formed on the lower substrate 66. The thin film transistor consists of a gate electrode and a source electrode and a drain electrode (not shown). The major difference of the field sequential liquid crystal display device 60 with the previous conventional liquid crystal display is that the field sequential liquid crystal display device does not need the color filters and has the back light having three light sources selectively turned on and off. The light sources Red, Green and Blue are driven respectively by an inverter (not shown) and each of light sources Red, Green and Blue is turned on and off one hundred and eighty times per second, and thus a color image is displayed using a residual image effect of eyes caused by the mixture of three colors, red, green and blue. Even though the light source is turned on and off one hundred and eighty time per second, to the naked eye the light source appears to be kept on. For example, if the light source Red is turned on and then the light source Blue is turned on, a mixed color violet is seen owing to the residual image effect. Whereas a total luminance of the conventional active-matrix liquid crystal display device is low owing to the low transmissivity of the color filter, the field sequential liquid crystal display device overcomes this problem because it does not have a color filter. In addition, the field sequential liquid crystal display device is suitable for a large scale liquid crystal display device because it can display a full-color using three color light sources, whereby it can display an image of high luminance and high resolution. Even though the conventional active-matrix liquid crystal display device is inferior to CRT (Cathode Ray Tube) in terms of price or clearness, the field sequential liquid crystal display device can settle this problems.

FIG. 3A is a cross-sectional view illustrating a wave guide type back light of the field sequential liquid crystal display device; FIG. 3B is a cross-sectional views illustrating a directly underlaid type back light of the field sequential liquid crystal display device. The wave guide type back light has light sources Red, Green and Blue disposed in a row at one edge or both edges of the liquid crystal panel 62 and diffuses light using a light guide panel and reflector. The wave guide type back light 74 may use a Cold Cathode Fluorescent Lamp (CCFL) as a light source and is suitable for notebook computers or the like because of its low weight and power consumption. The directly underlaid type back light 76 has light sources Red, Green and Blue 75 disposed in a repeated sequence of Red, Green and Blue under a scattering film 77 and irradiates light directly to the whole surface of the liquid crystal panel 62. The directly underlaid type back light is usually used for the image display device where the luminance is important and has a high power consumption because of its relatively big thickness and high ratio of diffusion.

FIG. 4A is a plane view showing a part of an array substrate. A plurality of horizontal gate bus lines 78 and vertical data bus lines 80 crossing gate bus lines are formed on the array substrate, and a thin film transistor is formed at every intersection of gate bus lines and data bus lines. A pixel electrode 79 electrically connected to the thin film transistor is formed on the array substrate. The conventional field sequential liquid crystal display device is driven by applying an image signal data to the data line 80 and scanning an electric pulse to the gate line 78. A line sequential driving method is used for the field sequential liquid crystal display device in order to improve a quality of an image, where a gate scan input driver applies a gate pulse voltage to one of gate lines at a time and applies the gate pulse voltage sequentially to the next gate line. One frame is completed when the gate pulse voltage is applied to all gate lines. That is, if the gate pulse voltage is applied to nth gate line 78, all of thin film transistors connected to the nth gate line 78 are turned on, and the image signal of the data line 80 is accumulated in liquid cells and in storage capacitors through the thin film transistor that have been turned on. Accordingly, liquid crystal molecules are realigned according to the image signal data accumulated in the liquid crystal cell and an image signal voltage, and then a desired image is displayed after the light from the back light passes through the liquid crystal cell.

FIG. 4B is a time chart showing a driving method of the conventional field sequential liquid crystal display device. The driving sequence of the conventional field sequential liquid crystal display device is as follows. After all thin film transistors for one of the light sources are turned on sequentially, the liquid crystal molecules become aligned according to the applied voltage, and then the next one of light sources is turned on. And the same process is repeated for other remaining light sources. Each of light sources Red, Green and Blue is driven one time respectively for a frame. The driving process of each of the light sources must be completed respectively within one period of sub-frame, i.e. ¼f. Taking one of light sources for example, a period of a sub-frame consists of a scanning time, a response time of the liquid crystal and a flashing time of the back light, and this relation can numerically be expressed as follow:

$$\tfrac{1}{4}f = t_{TFT} + t_{LC} + t_{BL}$$

where f is a frame frequency, $t_{TFT}$ (92) is a scanning time for all thin film transistors of sub-frame, $t_{LC}$ (94) is a response time of the assigned liquid crystal and $t_{BL}$ (96) is a flash time of the back light. If the frame frequency $t_{TFT}$ (92) is increased, whereas the flash time $t_{BL}$ (96) is kept constant, the response time $t_{LC}$ (94) decreases because the time period of one sub-frame is fixed. If the response time $t_{LC}$ (94) is decreased, and thus an actual response time of the liquid crystal becomes longer than the assigned response time of the liquid crystal, the back light is driven before the proper alignment of the liquid crystal occur, causing screen color to not be uniform.

FIG. 5 is a schematic diagram illustrating a sequence of color image display for one frame in the conventional field sequential liquid crystal display device. The one frame period of the field sequential liquid crystal display device is 1/60 second, and the sub-frame period for each of the light sources Red, Green and Blue is one-third of the one frame period, i.e., 1/180 second (5.5 msec). The actual lighting time of each of light sources Red, Green and Blue for a sub-frame becomes shorter than 1/180 second because color interference may happen when light sources Red, Green and Blue are driven as on-state continuously. As shown in the figure, a sequence for color image display for the field sequential liquid crystal display device is as follow. One frame "F" is divided into three sub-frames S1, S2 and S3 for each of the light sources Red, Green and Blue, and each of the light sources is sequentially turned on and off in order to display a color image by irradiating light to the liquid crystal panel (62).

FIG. 6 is a schematic diagram illustrating a sequence of color image display for one frame in the conventional field sequential digital light processing (DLP) device used for a projector, for example. The field sequential digital light processing device uses four light sources Red, Green, Blue and White. Because the field sequential digital light processing device irradiates light using a principle of reflection of mirror, it has a high efficiency of use of light and can display an image of higher luminance than a transmissive type of liquid crystal display device irradiating light from behind the liquid crystal panel. Because every control is accomplished digitally, and the device has a single plate structure, it is suitable for minimization of products. The field sequential digital light processing device controls a refraction ratio using an non-light emitting element instead of the liquid crystal. As shown in the figure, one frame "F" is divided into four sub-frames Sa, Sb, Sc and Sd for each of light sources Red, Green, Blue and White. Each of light sources is sequentially turned on and off in order to display a color image by irradiating light to the digital light processing panel (82). One frame period of the field sequential digital light processing device is 1/60 second, and the sub-frame period for each of the light sources Red, Green, Blue and White is one-fourth of the one frame period, i.e., 1/240 second.

SUMMARY OF THE INVENTION

Accordingly, the present invention is directed to a field sequential liquid crystal display device and a method of color image display for a field sequential liquid crystal display device that substantially obviates one or more of problems due to limitations and disadvantages of the related art.

An object of the present invention is to provide a field sequential liquid crystal display device having an image signal processor.

Another object of the present invention is to provide a color image display method for a field sequential liquid crystal display device including an image signal processor in which each of light sources Red, Green and Blue is driven sequentially for every divided area of a screen in order to compensate for low response time of a liquid crystal and accomplish fast driving of the field sequential liquid crystal display device.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a field sequential liquid crystal display device comprises a liquid crystal panel having an upper substrate, a lower substrate and a liquid crystal layer disposed therebetween, a back light disposed under the liquid crystal panel and irradiating a light to the liquid crystal panel and having 3 different light sources Red, Green and Blue sequentially driven; and an image signal processor controlling a lighting speed of each of light sources Red, Green and Blue. The liquid crystal mode is Optically Compensated Birefringence (OCB) mode. Each of light sources Red, Green and Blue of the back light is disposed at a down edge of the liquid crystal panel or at directly under of liquid crystal panel in a repeated sequence of Red, Green and Blue. The back light further includes a fourth light source and a color of the fourth light source is within a color range from Green to Blue.

In another aspect, a method of color image display for a field sequential liquid crystal display device including an image signal processor, comprises steps of dividing a frame into four sub-frames having a period of one-fourth of one frame period, driving each of light sources Red, Green and Blue sequentially at a first, a second and a third sub-frame, and driving a light source combination with three or fewer colors of Red, Green and Blue at a fourth sub-frame. The possible combination turned on at the fourth sub-frame is one of combinations consisting of all off, R, G, B, G+B, R+B, R+G, and all on. A one frame period is 1/60 second and a lighting time of the light source at each sub-frame is shorter than 1/240 second.

In another aspect, a method of color image display for a field sequential liquid crystal display device including an image signal processor, comprises steps of dividing a frame into four sub-frames having a period of one-fourth of one frame period, driving each of light sources Red, Green and Blue sequentially at a first, a second and a third sub-frame, driving a light source combination with three or fewer colors of Red, Green and Blue at a fourth sub-frame, classifying each component R, G and B of a color image input signal using a gray level having 256 levels, deciding a maximum luminance value of the field sequential liquid crystal display device using the gray level, obtaining an average luminance value of each of component R, G and B from the image input signal, turning on one of light sources Red, Green and Blue having a larger average luminance value than the maximum luminance value at the fourth sub-frame, and converting the input luminance value of component R, G and B and an input luminance value of the fourth sub-frame using the image signal processor. The possible combination turned on at the fourth sub-frame is one of combinations consisting of all off, R, G, B, G+B, R+B, R+G, and all on. The light source which is to be turned on at the fourth sub-frame is decided on the basis of a maximum luminance value of R, G and B. The one frame period is 1/60 second and a lighting time of the light source at each sub-frame is shorter than 1/240 second.

In another aspect, a method of color image display for a field sequential liquid crystal display device including an image signal processor, comprises steps of dividing a liquid crystal panel into n number of driving areas, turning on each of light sources Red, Green and Blue sequentially for every divided driving area, and having a time interval between driving sections of a previous light source and a next light source. The time interval is formed from a second divided driving area. If an Optically Compensated Birefringence (OCB) mode is selected for a liquid crystal, the time interval may be 0.5 msec~1 msec. The number n for divided driving area is dependent on a degree of a resolution of a liquid crystal display device and response time of the liquid crystal. Lighting time of a back light is also dependent on the degree of resolution of the liquid crystal display device and response time of the liquid crystal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiment of the present invention, which is illustrated in the accompanying drawings.

Figure 1:
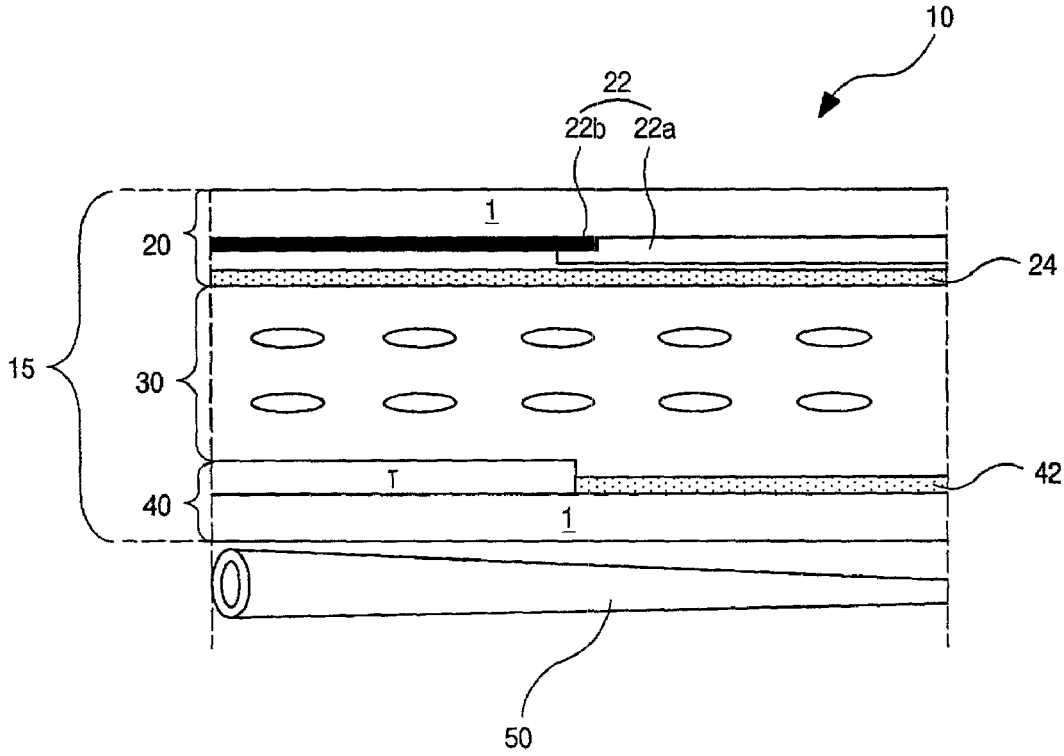
FIG. 1 is a cross-sectional view showing a cross section of a pixel of a conventional liquid crystal display device.
Figure 2:
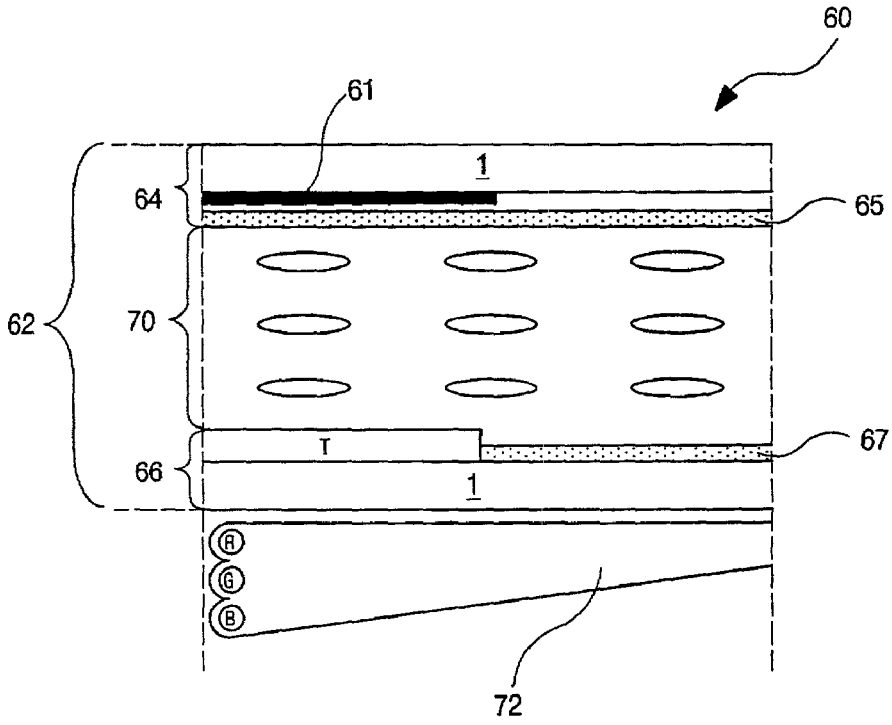
FIG. 2 is a cross-sectional view showing a cross section of a pixel of a conventional field sequential liquid crystal display device.
Figure 6:
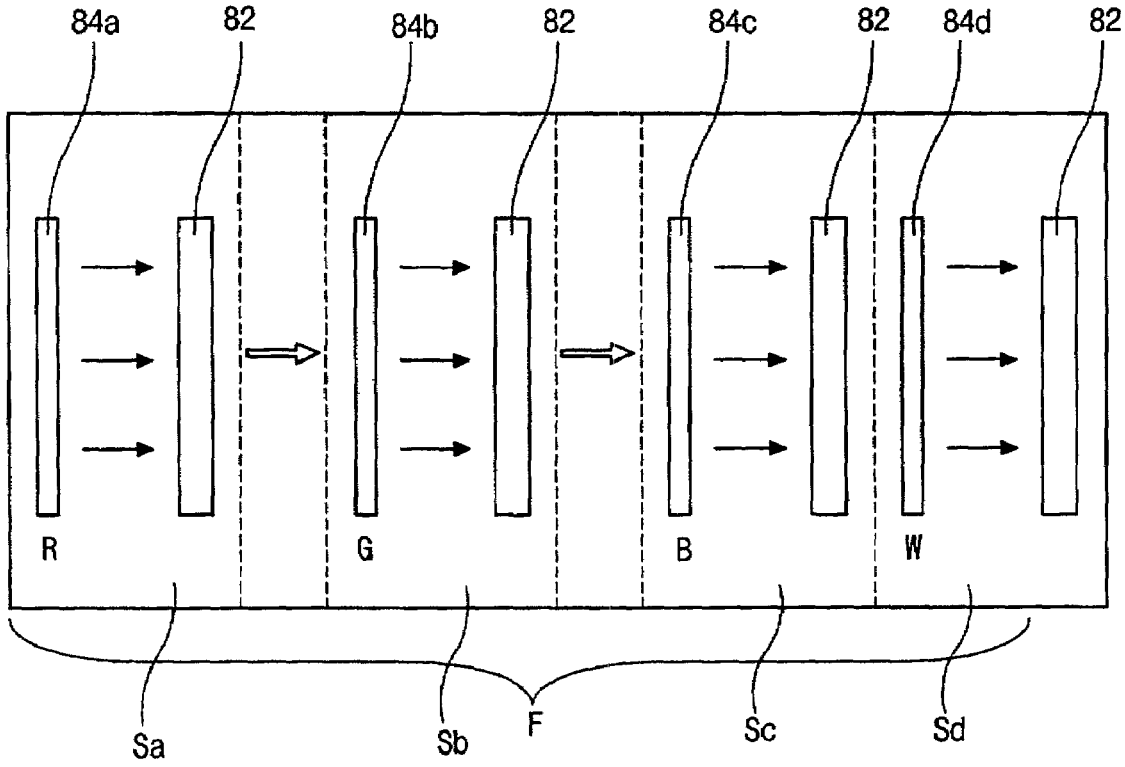
FIG. 6 is a schematic diagram illustrating a sequence of color image display for one frame in a conventional field sequential digital light processing (DLP) device used for a projector, for example.
Figure 7:
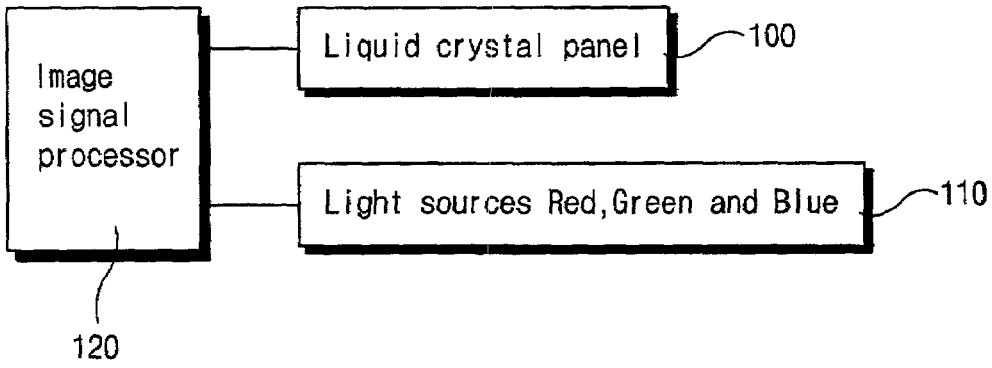
FIG. 7 is a schematic diagram illustrating a field sequential liquid crystal display device according to the present invention.

FIG. 7 is a schematic diagram illustrating a field sequential liquid crystal display device according to the present invention. The field sequential liquid crystal display device according to the present invention includes a liquid crystal panel 100 having an upper substrate and a lower substrate and liquid crystal layer disposed therebetween, a back light 110 having three light sources Red, Green and Blue and irradiating light to the liquid crystal panel 100, and an image signal processor 120 controlling a lighting speed of light sources Red, Green and Blue of the back light 110. The liquid crystal panel 100 and the back light 110 have a same structure as that of the conventional field sequential liquid crystal display device described before with respect to FIG. 2. One of Ferroelectric Liquid Crystal (FLC) mode, Optically Compensated Birefringent (OCB) mode and Twisted Nematic (TN) mode, for example, having a high response time is used for a liquid crystal mode. In addition, a non-light emitting element, instead of the liquid crystal, may be used in Digital Light Processing (DLP) devices as described with respect to FIG. 6.

Figure 8:
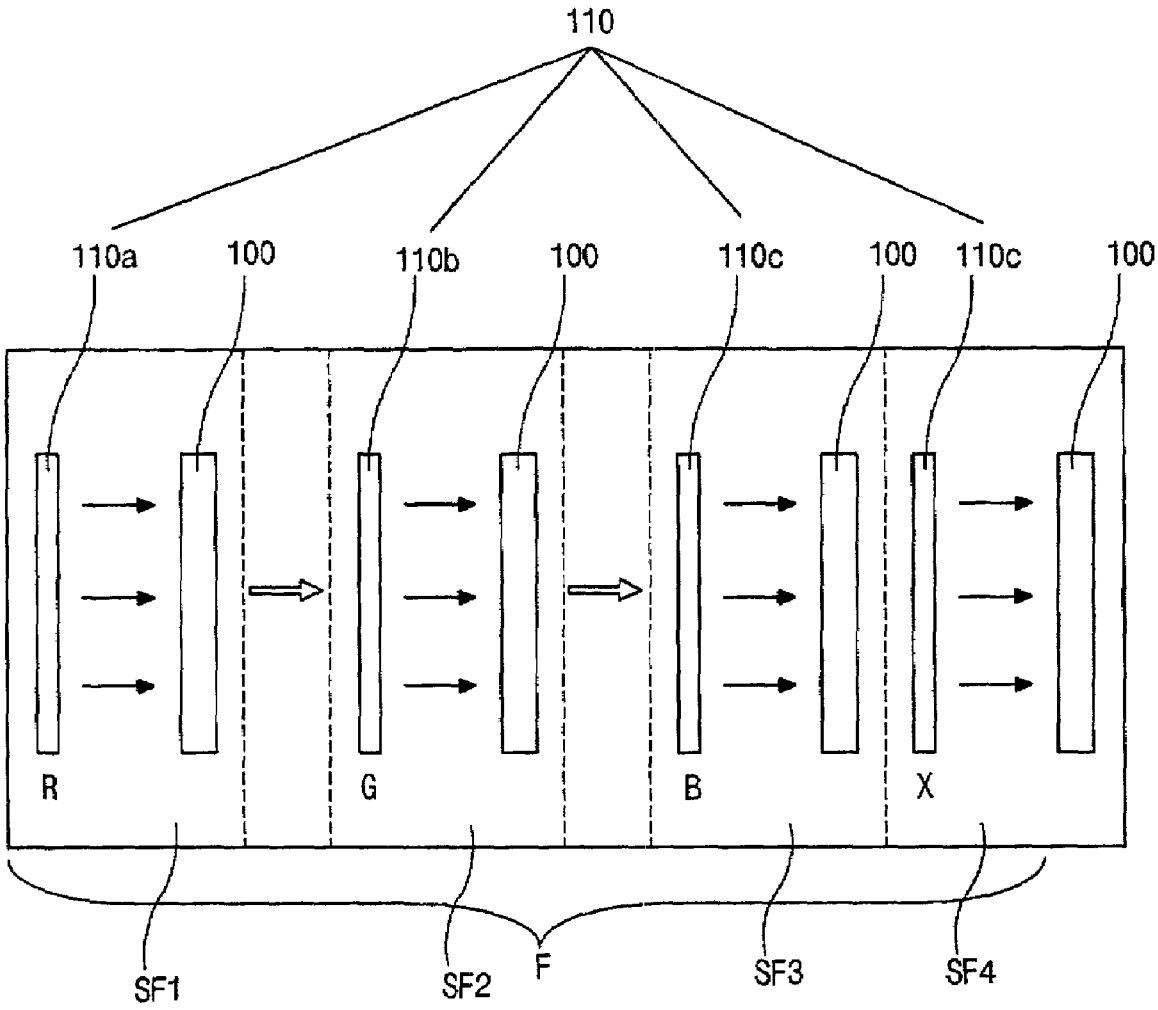
FIG. 8 is a schematic diagram illustrating a sequence of color image display for one frame in the field sequential liquid crystal display device according to the present invention.

A method and an algorithm for controlling the lighting speed of the back light 110 using the image signal processor will be described hereinafter with reference to FIGS. 8 and 9. FIG. 8 is a schematic diagram illustrating a sequence of color image display for one frame in the field sequential liquid crystal display device according to the present invention. When image signals having information on the respective components R, G and B are inputted into the field sequential liquid crystal display device, the image signal processor converts the lighting speeds of light sources Red, Green and Blue of the back light for every frame. As shown in the figure, one frame "F" is divided into four sub-frames having a period of one-fourth of one frame period. Each of light sources Red, Green and Blue 110*a*, 110*b* and 110*c* is turned on sequentially at the first, the second and the third sub-frame "SF1", "SF2" and "SF3" and a combination of light sources of three or fewer colors of R, G and B is turned on at the fourth sub-frame in order to display a color image. The light source turned on at the fourth sub-frame is defined as a light source "X" 110*d* in the figure.

In detail, when a luminance of the component R is read high from the image signal, the luminance of the component R may be increased by turning on the light source Red at the fourth sub-frame "SF4". If one color of Cyan, Magenta and Yellow, which are complementary colors of R, G and B, is particularly stressed among the image signal, the luminance of the stressed color may be increased by turning on two light sources among light sources Red, Green and Blue at the fourth sub-frame "SF4". In addition, the maximum luminance of a white color may be increased by turning on all light sources Red, Green and Blue at the same time at the fourth sub-frame. Accordingly, because the luminance of the stressed color may be increased and diverse colors may be displayed using the fourth sub-frame according to the present invention, the present invention can provide a liquid crystal display device having high qualities of image and can be used for devices requiring high quality images, for example, TV.

Figure 3A:
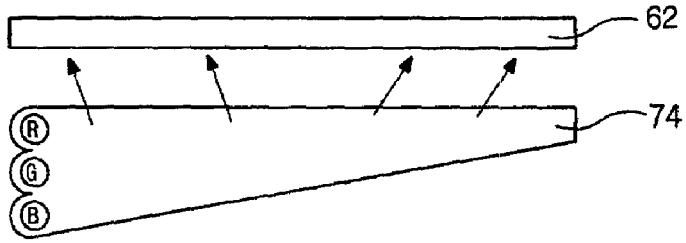
FIG. 3A is a view showing a structure of wave guide mode back light of field sequential liquid crystal display device.
Figure 3B:
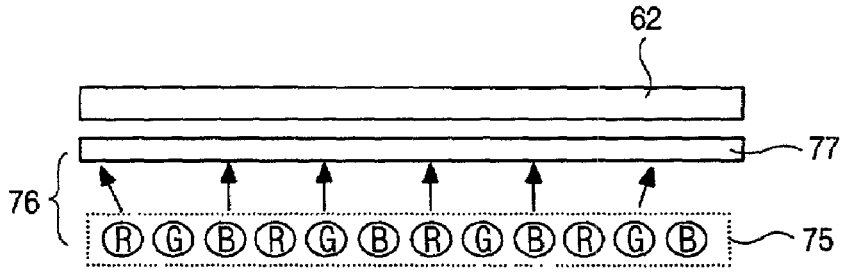
FIG. 3B is view showing a structure of directly underlaid mode back light of a conventional field-sequential liquid crystal display device.
Figure 9:
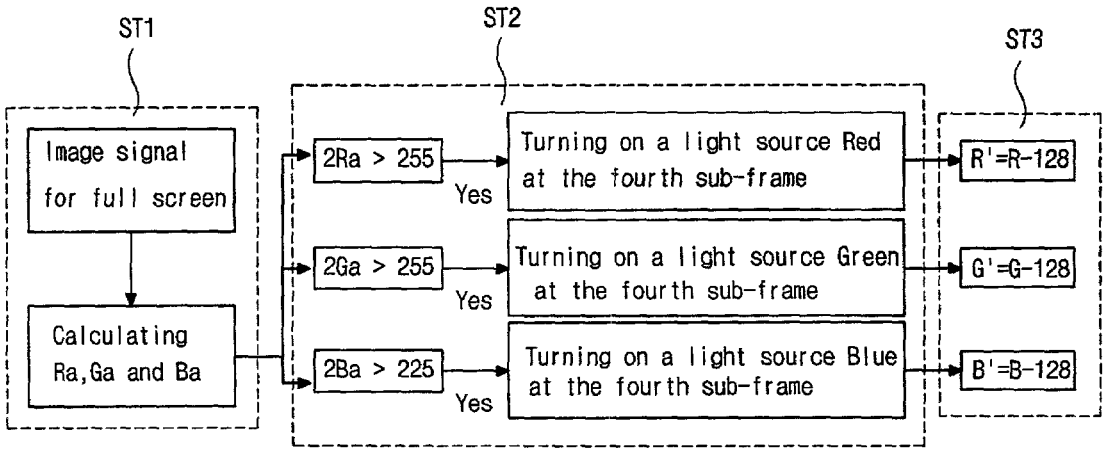
FIG. 9 is a flow chart illustrating a method for color image display for the field sequential liquid crystal display device according to the present invention.

FIG. 9 is a flow chart illustrating a method for color image display for the field sequential liquid crystal display device according to the present invention, and more particularly, a method for deciding a light source which is to be turned on at the fourth sub-frame. The luminance of each component R, G and B in color image signal is expressed with a gray level having 256 levels. When the luminance of each component R, G and B has a value of gray level 127, it is set as a maximum luminance. As shown in the figure, when the image signal for a fall screen is inputted, an average luminance value Ra, Ga and Ba of each of components R, G and B is calculated in ST1(step 1). Each of average luminance values Ra, Ga and Ba will be selected when it is bigger than the gray level 128. The light source which is to be turned on at the fourth sub-frame is decided in ST2 (step 2). The possible combination turned on at the fourth sub-frame is one of combinations consisting of all off, R, G, B, G+B, R+B, R+G, and all on. Input values for each sub-frame are converted in ST3 (step 3) by the image signal processor. That is, when the average luminance value Ra, Ga and Ba is bigger than the gray level 128, the light source corresponding to the component having a larger average luminance will be turned on at the fourth sub-frame. If all of the average luminance values Ra, Ga and Ba have values lower than the gray level 128, all light sources Red, Green and Blue are turned off at the fourth sub-frame. In addition, if only the average luminance value Ra has a value larger than the gray level 128, the image signal expressed as "(R,G,B)=(200,100,100)" may be converted to "(R,G,B,X)=(72,100,100,128)", where "X" is the light source which is to be turned on at the fourth sub-frame. Because only the light source Red is to be turned on at the fourth sub-frame in this example, the gray level of the component R becomes "72+128=200". This can be applied to light sources Green and Blue in same way when average luminance value Ga or Ba is larger than the gray level 128. If all average luminance values Ra, Ga and Ba are bigger than the gray level 128 (2Ra, 2Ga, 2Ba>255), the image signal expressed as "(R,G,B)=(200,250,130)" may be converted to "(R,G,B,X)=(72,122,2,128)" and in this case all light sources Red, Green and Blue are turned on at the fourth sub-frame. Here, the brightness of the back light can be varied as well as the input value of the fourth sub-frame in "ST3". For example, if the light source Red is to be turned on at the fourth sub-frame and the luminance of the light source Red is changed from the gray level 128 into the gray level 110, the image signal expressed as "(R,G,B)=(200,50,50)" can be converted to "(R,G,B,X)=(90,50,50,110)" as well as "(R,G,B,X)=(72,50,50,128)". In addition, a selection condition that the average luminance value should be larger than the gray level 128 can be changed, and although the algorithm in the example of FIG. 9 is made on the basis of an average luminance of the fall screen, the selection of the color to be displayed in the fourth sub-frame can be made on the basis of the maximum luminance of the full screen. The steps "ST2" and "ST3" are controlled by the image signal processor. (shown in FIG. 7). The back light for the present invention is selected from the wave guide mode or the directly-underlaid mode described in FIGS. 3A and 3B, and the on-and-offs of light sources can be controlled by the image signal processor. Even though the algorithm of FIG. 9 is one of embodiments suggested in order to explain the present invention, various algorithms having different conditions can be made in the method of color image display for the present invention without departing from the spirit or scope of the invention.

Figure 4A:
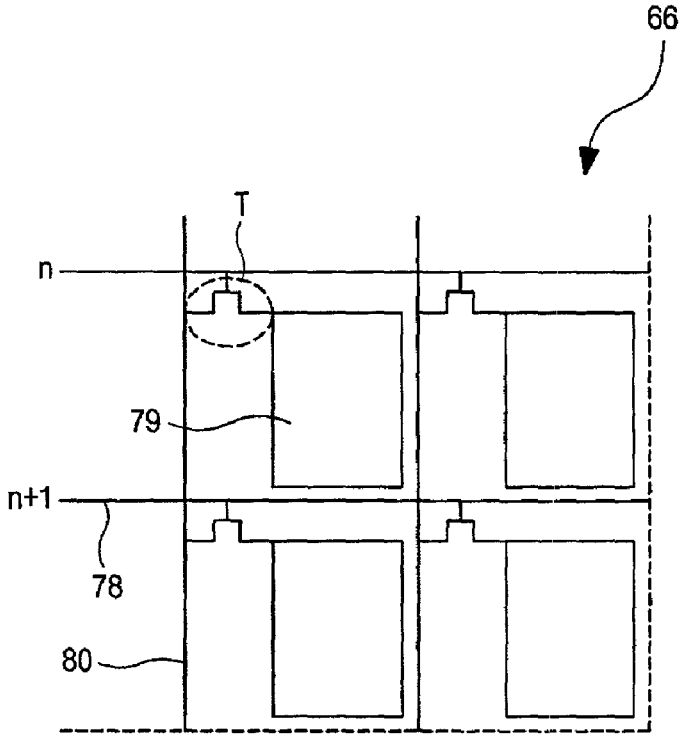
FIG. 4A is a plane view showing a part of a conventional array substrate.
Figure 4B:
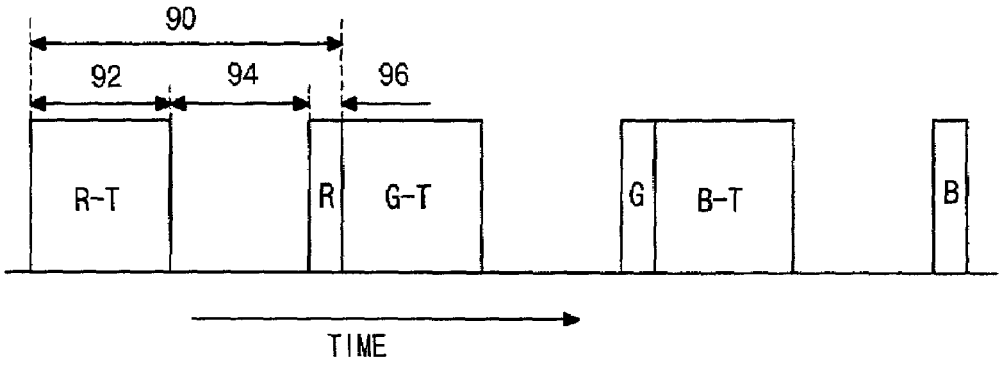
FIG. 4B is a time chart showing a driving method of a conventional field sequential liquid crystal display device.
Figure 5:
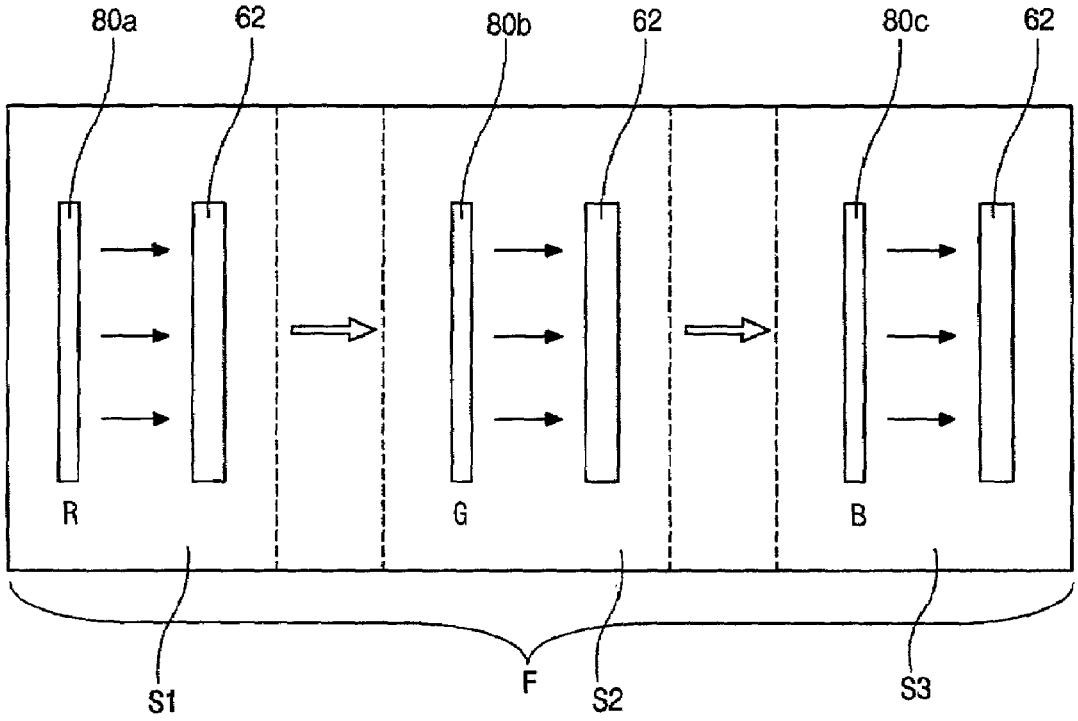
FIG. 5 is a schematic diagram illustrating a sequence of color image display for one frame in a conventional field sequential liquid crystal display device.
Figure 10:
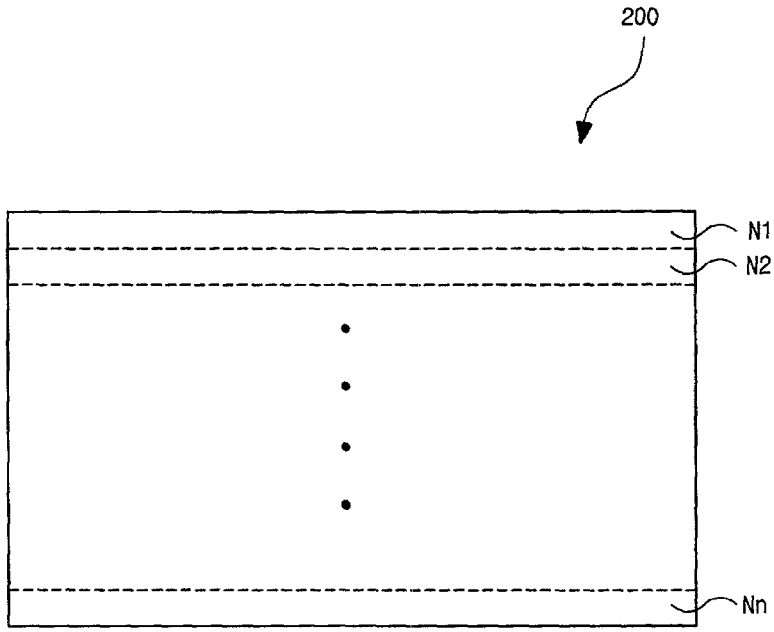
FIG. 10 is a plan view showing divided driving areas of the field sequential liquid crystal display device according to the present invention.

FIG. 10 is a plan view showing divided driving areas of the field sequential liquid crystal display device according to the present invention. The liquid crystal panel 200 may be divided into n number of divided driving areas "N1", "N2", . . . , "Nn". The number of driving areas n is dependent on the degree of resolution of the liquid crystal display device and response time of the liquid crystal. The driving speed and the luminance of the liquid crystal display device according to the present invention can be increased by dividing a driving area and turning on each of light sources Red, Green and Blue for every divided driving area, whereas in the conventional field sequential liquid crystal display device, each of light sources is turned on one time for a frame as described in FIG. 4B. In addition, the one frame is divided into four sub-frames having a period of one-fourth of one frame period. Both the number of divided driving areas for liquid crystal panel and the number of light sources Red, Green and Blue of the back light do not need to be the same, and the number of divided driving areas for light sources Red, Green and Blue of the back light may actually be designed with a fewer number.

Figure 11:
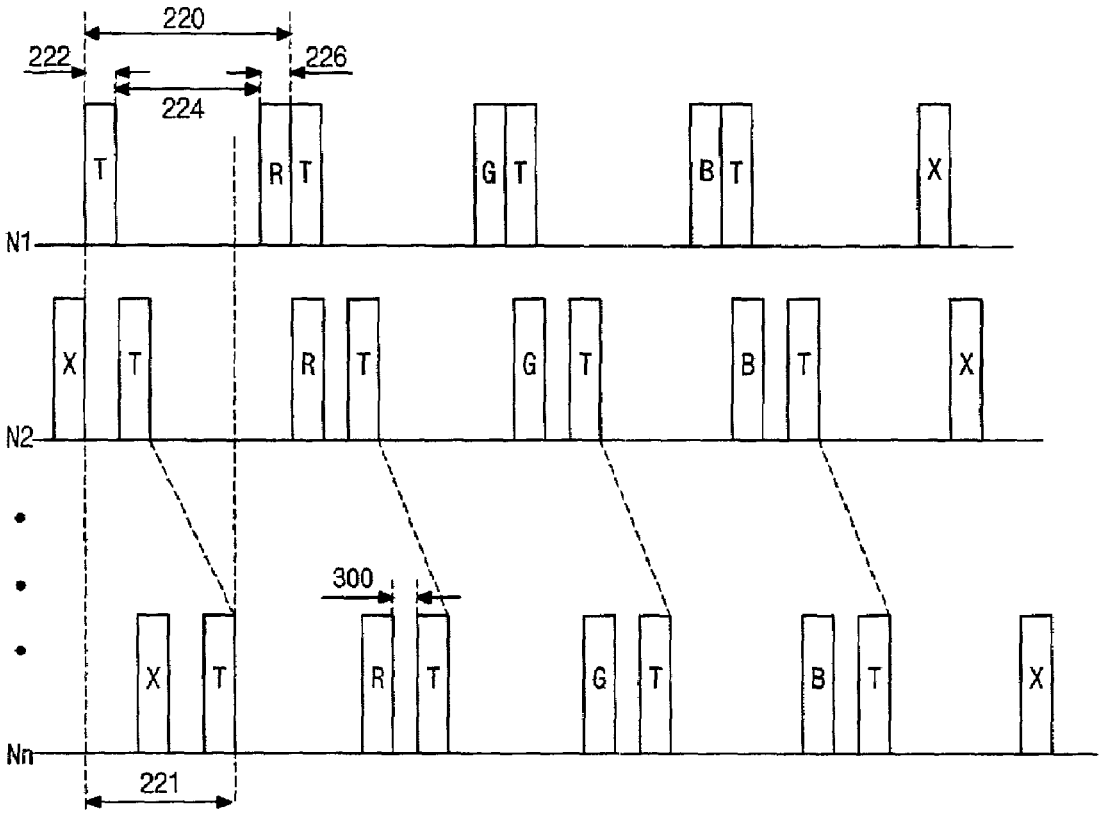
FIG. 11 is a schematic diagram illustrating a driving method for divided driving areas for the field sequential liquid crystal display device according to the present invention.

FIG. 11 is a schematic diagram illustrating a driving method for divided driving areas for a field sequential liquid crystal display device according to the present invention. As shown in the figure, the back light is turned on after the response of thin film transistor T and liquid crystal at every divided driving area. A period of a subframe consists of a scanning time, a response time of the liquid crystal and a flashing time of the back light. This relation can numerically be expressed as follow:

$$\tfrac{1}{4}f(220)=t_{TFT}(222)+t_{LC}(224)+t_{BL}(226)$$

where f is a frame frequency, $t_{TFT}$ is a scanning time for all thin film transistors of sub-frame, $t_{LC}$ is a response time of the assigned liquid crystal, and $t_{BL}$ is a flash time of the back light. The scanning time of thin film transistors of each light source for all the divided driving areas is $t_{TFT}$(221). When the back light is turned on in a sequence of R, G, B and X, each of light sources is turned on in a sequence as follows:

R of N1, R of N2, . . . , R of Nn, G of N1, G of N2, . . . , G of Nn, B of N1, B of N2, . . . , B of Nn, X of N1, X of N2, . . . , X of Nn.

The light source X is a light source which is made from the combination of light sources of three or fewer colors of R, G and B and is to be turned on at the fourth sub-frame. The second divided driving area N2 is decided by the degree of resolution of a screen and response time of the liquid crystal. A time interval $t_D$ (300) between driving sections of a previous light source and a next light source is also dependent on the degree of resolution of the screen and the response time of the liquid crystal. This time interval $t_D$ (300) is formed between driving sections of light sources of divided driving areas from N2 to Nn, but not in the first divided driving area N1. The time interval $t_D$ (300) is formed in order to remove an effect of a leakage of light generated when the back light is flashed before the liquid crystal for next light source is aligned, and the value of the time interval $t_D$ (300) is dependent on the response time of the liquid crystal. For example, when Optically Compensated Birefringent (OCB) mode is selected for the liquid crystal the time interval $t_D$ (300) may be 0.5~1 msec. Because four light sources Red, Green, Blue and X are used in the present invention, it is possible to accomplish a higher luminance. And because it is possible to compensate a retarded response time of the liquid crystal and thus protect the leakage of light by driving the liquid crystal display device according to divided driving areas, the present invention can provide a liquid crystal display device having an image of higher qualities.

Figure 12:
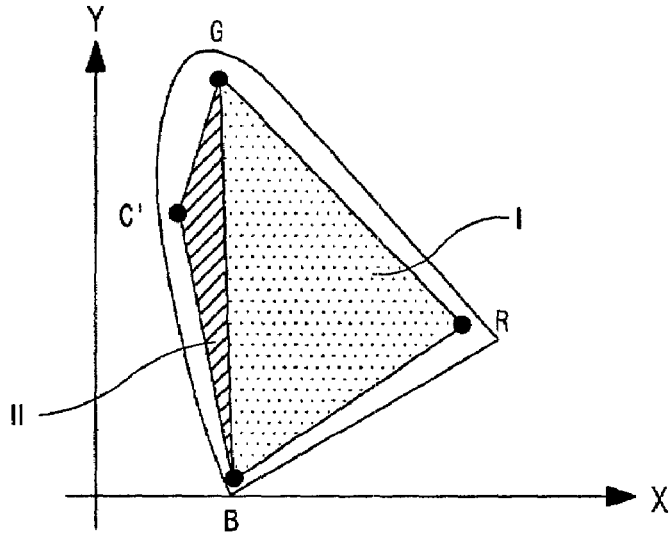
FIG. 12 is a schematic diagram showing color coordinates of a color gamut of the field sequential liquid crystal display device according to the present invention.

FIG. 12 is a schematic diagram showing a color coordinates of a color gamut of the field sequential liquid crystal display device according to the present invention. If only light sources Red, Green and Blue are used for the liquid crystal display device, a color range that can be actually displayed is narrower than a color range that a human observer can perceive. But if a light source displaying a fourth color is added, a color gamut that can be displayed is able to be broadened. As shown in the figure, four dots (R, G, B and C') mean positions of color coordinates of light sources Red, Green, Blue and C'. A color coordinate region I is formed with light sources Red, Green and Blue and a color coordinate region II is formed with the fourth color C' added. Because the color coordinate region II cannot be made with only three light sources Red, Green and Blue, the color gamut that can be displayed becomes broadest when the color C' is close to the color Cyan, which is between a color of Green and Blue. That is, if four light sources Red, Green, Blue and C' are used, and the light source C' is turned on at the fourth sub-frame, the color gamut that is to be displayed can be broadened. The field sequential liquid crystal display device according to the FIG. 12 has a same structure as that of the field sequential liquid crystal display device according to the FIG. 7, but the present embodiment according to the FIG. 12 has four light sources for four colors.

Figure 13A:
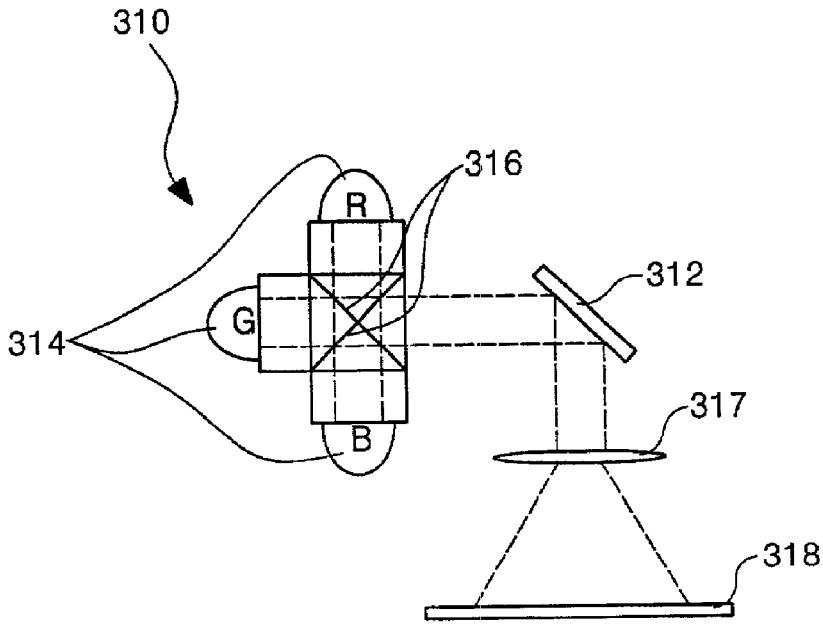
FIGS. 13A and 13B are schematic diagram illustrating a projector system, for example, among field sequential liquid crystal display devices according to the present invention.
Figure 13B:
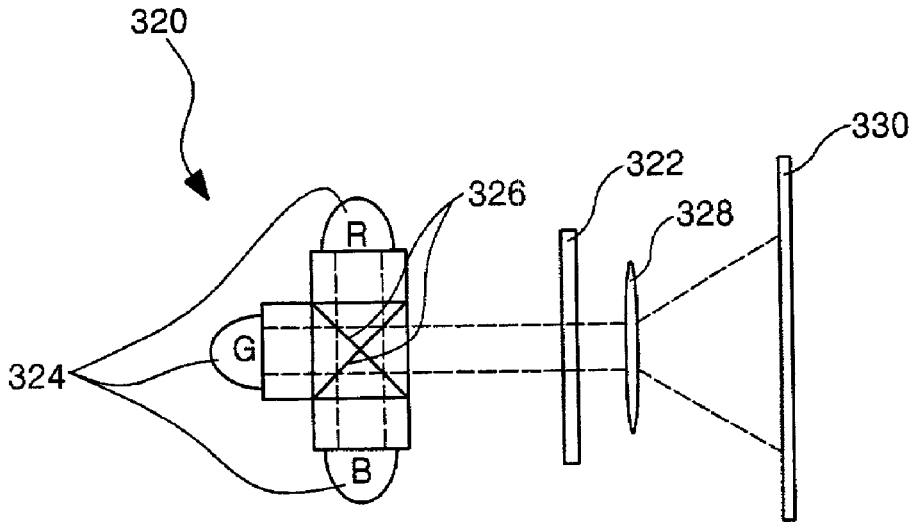

A display device including light sources Red, Green and Blue and being sequentially driven according to the present invention will be taken for an example in the following. FIGS. 13A and 13B are schematic diagram illustrating a projector system, for example, among field sequential liquid crystal display devices according to the present invention. The projector system is one of color image display devices which enlarges and then projects various moving images or stationary images transmitted from such electronic goods as video player, television set and computer, and is expected to be broadly used for domestic uses, for example, at various meetings or playing movies in the small theater. FIG. 13A shows a reflective type projector system and this field sequential reflective projector system 310 comprises an image generator 312, light sources Red, Green and Blue 314 sequentially driven and for irradiating light to the image generator 312, a dichroic mirror 316 for gathering and transmitting a light from light sources 314 to the image generator 312, a lens 317 for enlarging and controlling an image formed at the image generator 312, and a screen 318 to which the image of the image generator 312 is projected through the lens 317. A reflective type liquid crystal display device and Digital Light Processing (DLP) devices, for example, may be used for the image generator 312 of the reflective type projector system. Though the reflective type liquid crystal display device is an image display device displaying an image using external light without the back light, the liquid crystal display device used for the reflective type projector system displays an image using light sources Red, Green and Blue. Because the Digital Light Processing (DLP) device is an image display device displaying an image using the principle of reflection of a mirror, the efficiency of use of light is high.

FIG. 13B shows a transmissive type projector system and this field sequential transmissive projector system 320 comprises an image generator 322, light sources Red, Green and Blue 324 sequentially driven for irradiating light to the image generator 322, a dichroic mirror 326 gathering and transmitting a light from light sources 324 to the image generator 322, a lens 328 for enlarging and controlling an image formed at the image generator 322, and a screen 330 to which the image of the image generator 322 is projected through the lens 328. A transmissive liquid crystal display device, i.e., a conventional liquid crystal display device, may be used for the image generator of the transmissive type projector system. Though the light sources Red, Green and Blue are disposed in a triangular form in FIGS. 13A and 13B, they can be disposed in a different configuration, as can be recognized by one of ordinary skill in the art.

It will be apparent to those skilled in the art that various modifications and variations can be made in the field sequential liquid crystal display device and the method of color image display of the present invention without departing from the spirit or scope of the invention. Thus, it is intended that the present invention cover the modifications and variations of this invention provided they come within the scope of the appended claims and their equivalents.

What is claimed is:

1. A field sequential liquid crystal display device, comprising:

a liquid crystal panel having an upper substrate, a lower substrate and a liquid crystal layer therebetween;

a back light under the liquid crystal panel for irradiating light to the liquid crystal panel and having different light sources for each of the colors Red, Green and Blue; and a means for controlling a lighting speed of each of light sources Red, Green and Blue, where the light sources are sequentially driven wherein the means indicates a stressed color corresponding to one of the light sources and the means turns on the light sources according to an average luminance value obtained with a luminance value of color components R, G, and B.

2. The device according to claim 1, wherein the liquid crystal layer mode is Optical Compensated Birefringent (OCB) mode.

3. The device according to claim 1, wherein the liquid crystal layer mode is Ferroelectric Liquid Crystal (FLC) mode.

4. The device according to claim 1, wherein each of the light sources is disposed at a down edge of the liquid crystal panel.

5. The device according to claim 1, wherein each of the light sources is disposed directly under of the liquid crystal panel in a repeated sequence of Red, Green and Blue.

6. The device according to claim 1, wherein the back light further includes a fourth light source.

7. The device according to claim 6, wherein a color of the fourth light source is within a color range from Green to Blue.

8. A method of color image display for a field sequential liquid crystal display device including an image signal processor, comprising:

dividing a frame into four sub-frames, each sub-frame having a period of one-fourth of one frame period;

driving each of light sources Red, Green and Blue sequentially at a first, a second and a third sub-frame;

driving a combination of the light sources, the combination having up to three colors at a fourth sub-frame;

classifying a color image input signal into color components R, G and B using a gray level having 256 levels;

deciding a maximum luminance value of the field sequential liquid crystal display device using the gray level; and obtaining an average luminance value of each of the components R, G and B from the color image input signal.

9. The method according to claim 8, wherein the combination of light sources turned on at the fourth sub-frame is one of combinations consisting of all off, R, G, B, G+B, R+B, R+G, and all on.

10. The method according to claim 8, wherein one frame period is 1/60second.

11. The method according to claim 10, wherein a lighting time of the light source at each sub-frame is shorter than 1/240second.

12. A method of color image display for a field sequential liquid crystal display device including an image signal processor, comprising:

dividing a frame having a frame period into four sub-frames having a period of one-fourth of one frame period;

driving each of light sources Red, Green and Blue sequentially at a first, a second and a third sub-frame, respectively;

driving a light source combination with a combination of colors Red, Green and Blue at a fourth sub-frame;

classifying a color image input signal into color components R, G and B using a gray level having 256 levels;

deciding a maximum luminance value of the field sequential liquid crystal display device using the gray level;

obtaining an average luminance value of each of the components R, G and B from the color image input signal; and turning on light sources Red, Green and Blue corresponding to the one of the color components R, G and B having an average luminance value greater than the maximum luminance value at the fourth sub-frame.

13. The method of claim 12 further comprising: converting the input luminance value of component R, G and B and an input luminance value of the fourth sub-frame using the image signal processor.

14. The method according to claim 13, wherein a lighting time of the light source at each sub-frame is less than 1/240 second.

15. The method according to claim 12, wherein the light source which is to be turned on at the fourth sub-frame is decided on the basis of a maximum luminance value of R, G and B.

16. The method according to claim 12, wherein the frame period is 1/60 second.

17. The method according to claim 12, wherein a combination of light sources and R, G, and B turned on at the fourth sub-frame is one of combinations consisting of all off, R, G, B, G+B, R+B, R+G, and all on.

18. A method of color image display for a field sequential liquid crystal display device including an image signal processor, comprising:

dividing a frame into four sub-frames, each sub-frame having a period of one-fourth of one frame period;

driving each of light sources Red, Green and Blue sequentially at a first, a second and a third sub-frame, and driving a fourth light source having a combination of the light sources at a fourth sub-frame classifying a color image input signal into color components R, G and B using a gray level having 256 levels;

deciding a maximum luminance value of the field sequential liquid crystal display device using the gray level; and obtaining an average luminance value of each of the components R, G and B from the color image input signal.

19. The method according to claim 18, wherein the combination of light sources turned on at the fourth sub-frame is one of combinations consisting of all off, R, G, B, G+B, R+B, R+G, and all on.

20. The method according to claim 18, wherein one frame period is 1/60 second.

21. The method according to claim 20, wherein a lighting time of the light source at each sub-frame is shorter than 1/240 second.

* * * * *